US008558763B2

(12) United States Patent
Kim

(10) Patent No.: US 8,558,763 B2
(45) Date of Patent: Oct. 15, 2013

(54) ORGANIC LIGHT EMITTING DISPLAY APPARATUS AND DRIVING METHOD THEREOF

(75) Inventor: Hyeong-Gwon Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 896 days.

(21) Appl. No.: 11/698,097

(22) Filed: Jan. 26, 2007

(65) Prior Publication Data

US 2008/0030435 A1 Feb. 7, 2008

(30) Foreign Application Priority Data

Aug. 4, 2006 (KR) ..... 10-2006-0073768

(51) Int. Cl.
*G09G 3/30* (2006.01)

(52) U.S. Cl.
USPC ..... 345/76; 345/77; 345/690

(58) Field of Classification Search
USPC ..... 345/36–39, 41–42, 45–46, 48, 50–55, 345/76–77, 82–84, 87–88, 90, 92, 94–96, 345/99–10, 104, 204, 208, 210–214; 315/169.3
See application file for complete search history.

(56) References Cited

U.S. PATENT DOCUMENTS 6,847,172 B2 * 1/2005 Suzuki ..... 315/169.3
6,950,081 B2 * 9/2005 Akimoto et al. ..... 345/55
7,274,363 B2 * 9/2007 Ishizuka et al. ..... 345/211
7,280,103 B2 * 10/2007 Taoka et al. ..... 345/204
7,746,317 B2 * 6/2010 Fu et al. ..... 345/102
7,920,109 B2 * 4/2011 Chung ..... 345/82
8,094,098 B2 * 1/2012 Lee ..... 345/77
8,154,478 B2 * 4/2012 Park et al. ..... 345/76
8,154,482 B2 * 4/2012 Lee et al. ..... 345/77
2004/0263495 A1 * 12/2004 Sugino et al. ..... 345/204

(Continued)

FOREIGN PATENT DOCUMENTS

KR 2005-3839 1/2005
KR 2006-87187 8/2006

OTHER PUBLICATIONS

Office Action issued by the Korean Patent Office on Jan. 13, 2009.

*Primary Examiner* — William Boddie
*Assistant Examiner* — Mansour M Said
(74) *Attorney, Agent, or Firm* — Christie, Parker & Hale, LLP

(57) ABSTRACT

An organic light emitting display apparatus, capable of removing motion blurring and preventing deterioration in brightness and an increase in power consumption, and a driving method thereof. The organic light emitting display apparatus includes: a plurality of pixels, each pixel including an organic light emitting device (OLED) and a pixel circuit; a data driver applying a data signal to a plurality of data lines connected to the pixels; a scan driver applying a selection signal to a plurality of selection scan lines connected to the pixels; a double speed timing generator doubling a frame frequency and applying a double speed frame signal to the scan driver; and a data signal converter doubling an input data signal, dividing one frame into two frames, applying a first data signal having a level higher than a level of the input data signal in one frame of the two frames, and applying a second data signal having a level lower than the level of the input data signal in the other frame of the two frames.

16 Claims, 7 Drawing Sheets

(56) References Cited

U.S. PATENT DOCUMENTS

2005/0057191 A1* 3/2005 Jo et al. ..... 315/291
2005/0162360 A1* 7/2005 Ishihara et al. ..... 345/89
2006/0107146 A1* 5/2006 Kim et al. ..... 714/727
2006/0125810 A1* 6/2006 Lee ..... 345/204
2006/0158398 A1* 7/2006 Akimoto et al. ..... 345/77
2006/0208977 A1* 9/2006 Kimura ..... 345/76
2007/0146394 A1* 6/2007 Ahn ..... 345/690
2007/0296668 A1* 12/2007 Kim et al. ..... 345/89

* cited by examiner

ORGANIC LIGHT EMITTING DISPLAY APPARATUS AND DRIVING METHOD THEREOF

CROSS-REFERENCE TO RELATED APPLICATION

This application claims the benefit of Korean Patent Application No. 2006-73768, filed on Aug. 4, 2006, in the Korean Intellectual Property Office, the disclosure of which is incorporated herein by reference.

BACKGROUND OF THE INVENTION

1. Field of the Invention

An aspect of the present invention relates to an organic light emitting display apparatus, capable of removing motion blurring and preventing deterioration in brightness and increase in consumption power, and a driving method thereof.

2. Description of the Related Art

In general, light emitting display apparatuses display images using emissive devices. Such light emitting display apparatuses are classified into inorganic light emitting display apparatuses having a light emitting layer made of an inorganic material, and organic light emitting display apparatuses having a light emitting layer made of an organic material.

In an organic light emitting display apparatus, electrons and holes injected into an organic thin film through cathodes and anodes are recombined to form excitons, and light having a specific wavelength is emitted from the excitons.

The organic thin film has a multi-layer structure including a hole transport layer, a light emitting layer, and an electron transport layer, in order to improve light-emitting efficiency. Also, the organic thin film includes an electron injection layer or a hole injection layer in order to improve injection efficiency of electrons or holes and distribute the electrons and holes uniformly.

Driving methods of the organic light emitting display apparatus are classified into a passive matrix method and an active matrix method. In the passive matrix method, lines are sequentially selected and driven using an organic light emitting display apparatus in which anodes and cathodes are formed in a manner to intersect each other. The organic light emitting display apparatus driven by the passive matrix method has a simple structure which can be easily implemented. However, such an organic light emitting display apparatus consumes a large amount of current when driving a large screen, and a driving time of each light emitting device in a frame is short.

The active matrix method controls the amount of current which flows through respective light emitting devices, using active devices. The active devices may be thin film transistors (TFTs). The active matrix method consumes a small amount of current and has a long light emitting time, however, this method has a problem of motion blurring.

Motion blurring or blurring motion is a phenomenon in which pictures overlap or appear blurry when they move on the screen. The blurring motion affects organic light emitting display apparatuses and liquid crystal display apparatuses driven by the active matrix method, but has no effect on impulse type display apparatuses such as cathode ray tubes (CRT).

In the case of the impulse type display apparatuses, as illustrated in FIG. 1, by momentarily displaying light corresponding to different amounts of brightness to each pixel, afterimages are reduced. Meanwhile, in hold type display apparatuses, as illustrated in FIG. 2, by continuously displaying light, corresponding to an amount of brightness required for display, during a constant time to each pixel, afterimages are increased.

In order to improve motion blurring of the hold type display apparatuses, an impulse type driving method similar to a CRT display method has been developed. FIG. 3 is a graph illustrating an example in which the impulse type driving method is applied to a conventional hold type display apparatus. Referring to FIG. 3, in the hold type display apparatus, black frame images are inserted between successive frame images in order to implement the impulse type driving method.

However, an average brightness of the entire screen is reduced by the amount of the inserted black frame images. To solve this problem, current flowing through light-emitting diodes is increased when moving pictures are driven, however, this increase in current also increases power consumption.

SUMMARY OF THE INVENTION

An aspect of the present invention provides an organic light emitting display apparatus, capable of removing motion blurring and preventing deterioration in brightness and an increase in power consumption, and a driving method thereof.

According to an aspect of the present invention, there is provided an organic light emitting display apparatus including: a plurality of pixels, each pixel including an organic light emitting device (OLED) and a pixel circuit; a data driver applying a data signal to a plurality of data lines connected to the pixels; a scan driver applying a selection signal to a plurality of selection scan lines connected to the pixels; a double speed timing generator doubling a frame frequency and applying a double speed frame signal to the scan driver; and a data signal converter doubling an input data signal, dividing one frame into two frames, applying a first data signal having a level higher than a level of the input data signal in one frame of the two frames, and applying a second data signal having a level lower than the level of the input data signal in the other frame of the two frames.

According to another aspect of the present invention, the organic light emitting display apparatus further includes an emission driver applying an emission signal to a plurality of emission scan lines connected to the pixels.

According to another aspect of the present invention, the double speed timing generator doubles the frame frequency to generate the double speed frame signal, and applies the double speed frame signal to the emission driver.

According to another aspect of the present invention, the organic light emitting display apparatus further includes a data synchronization emission control signal generator generating an emission control signal synchronized with the input data signal and applying the emission control signal to the emission driver.

According to another aspect of the present invention, a level difference between the first data signal and the input data signal is equal to a level difference between the second data signal and the input data signal.

According to another aspect of the present invention, the selection scan lines include a first selection scan line and a second selection scan line, the pixel circuit includes a first switching transistor, a second switching transistor, a first capacitor, a second capacitor, and a driving transistor, the first switching transistor transfers a data voltage applied to the plurality of data lines in response to a first selection signal applied to the first selection scan line, the first capacitor stores a voltage corresponding to a threshold voltage of the driving transistor, the second capacitor stores a voltage corresponding to the transferred data voltage, the second switching transistor connects a terminal of the first capacitor to a power supply line, in response to a second selection signal applied to the second selection scan line, and the driving transistor supplies a current from the power supply line to the organic light emitting device, in correspondence to the voltages stored in the first capacitor and the second capacitor.

According to another aspect of the present invention, the pixel circuit further includes a third switching transistor diode-connecting the driving transistor in response to the second selection signal.

According to another aspect of the present invention, the organic light emitting display apparatus further includes an emission driver applying an emission signal to the plurality of emission scan lines connected to the pixels, wherein the pixel circuit further includes a fourth switching transistor disconnecting the organic light emitting device from the driving transistor, in response to the emission signal applied to the emission scan lines.

According to another aspect of the present invention, there is provided an organic light emitting display apparatus including: a plurality of pixels, each pixel having an organic light emitting device and a pixel circuit; a data driver applying a data signal to a plurality of data lines connected to the pixels; a scan driver applying a selection signal to a plurality of selection scan lines connected to the pixels; a double speed timing generator doubling a frame frequency and applying a double speed frame signal to the scan driver; and a data signal converter doubling an input data signal, dividing a frame into two frames, and applying a signal with a triangular wave over the two frames.

According to another aspect of the present invention, the data signal converter applies a signal gradually rising from a first level lower than a level of the input data signal to the level of the input data signal in a first frame of the two frames, and applies a signal gradually falling from the level of the input data signal to a second level lower than the level of the input data signal in a second frame of the two frames.

According to another aspect of the present invention, the first level is equal to the second level.

According to another aspect of the present invention, the organic light emitting display apparatus further includes an emission driver applying an emission signal to a plurality of emission scan lines connected to the pixels.

According to another aspect of the present invention, the double speed timing generator doubles the frame frequency to generate the double speed frame signal, and applies the double speed frame signal to the emission driver.

According to another aspect of the present invention, the organic light emitting display apparatus further includes a data synchronization emission control signal generator generating an emission control signal synchronized with a data signal and applying the emission control signal to the emission driver.

According to another aspect of the present invention, there is provided a driving method of an organic light emitting display apparatus, including: doubling a frame frequency of signals applied to pixels of an organic light emitting display and dividing one frame into two frames; and applying a first data signal having a level higher than a level of an input data signal in one frame of the two frames and applying a second data signal having a level lower than the level of the input data signal in the other frame of the two frames.

According to another aspect of the present invention, a level difference between the first data signal and the input data signal is equal to a level difference between the second data signal and the input data signal.

According to another aspect of the present invention, there is provided a driving method of an organic light emitting display apparatus including: doubling a frame frequency of signals applied to pixels of the organic light emitting display apparatus and dividing one frame into two frames; and applying a data signal with a triangular wave over the two frames.

According to another aspect of the present invention, a signal gradually rising from a first level lower than a level of an input data signal to the level of the input data signal is applied in a first frame of the two frames, and a signal gradually falling from the level of the input data signal level to a second level lower than the level of the input data signal is applied in a second frame of the two frames.

According to another aspect of the present invention, the first level is equal to the second level.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
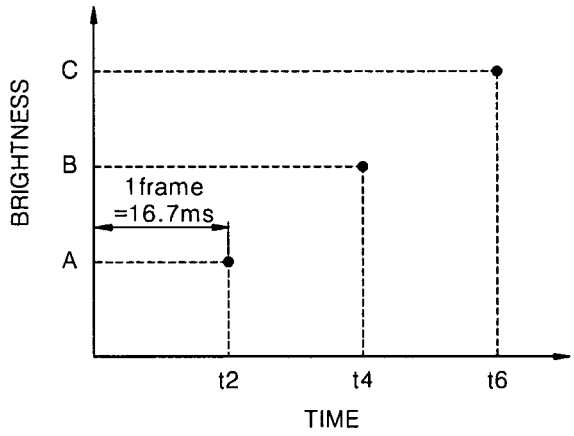
FIG. 1 is a graph explaining a display method performed by a conventional impulse type display apparatus.
Figure 2:
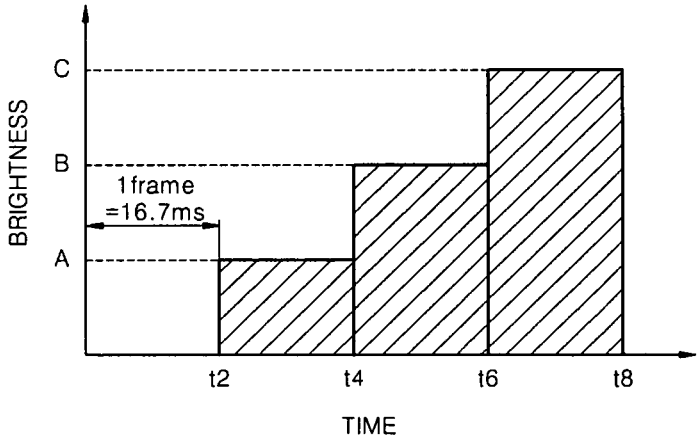
FIG. 2 is a graph explaining a display method performed by a conventional hold type display apparatus.
Figure 3:
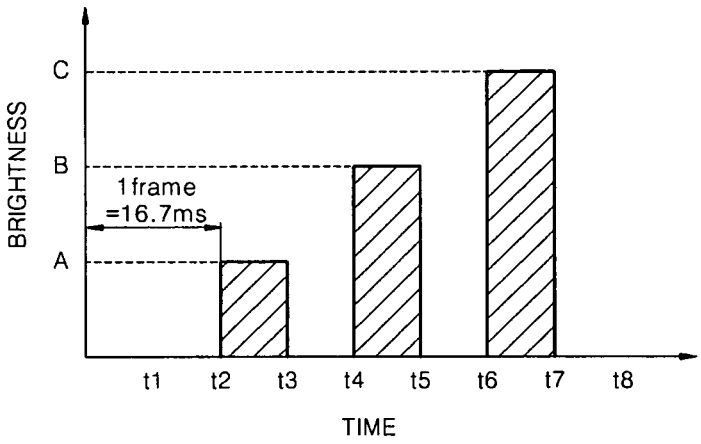
FIG. 3 is a graph illustrating an example in which an impulse type driving method is applied to a conventional hold type display apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
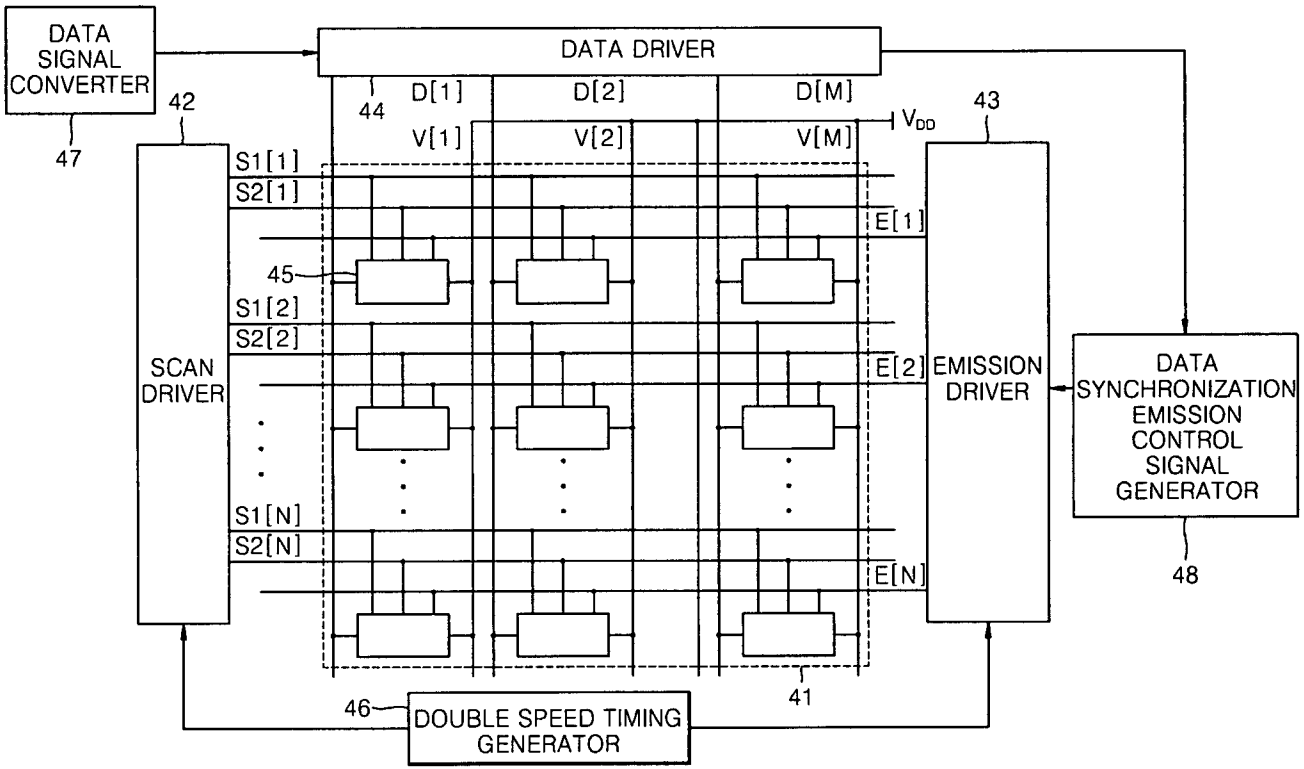
FIG. 4 is a block diagram of an organic light emitting display apparatus according to an embodiment of the present invention.

FIG. 4 is a block diagram of an organic light emitting display apparatus according to an embodiment of the present invention.

Referring to FIG. 4, the organic light emitting display apparatus includes an image display unit 41, a scan driver 42, an emission driver 43, a data driver 44, a double speed timing generator 46, a data signal converter 47, and a data synchronization emission control signal generator 48.

The image display unit 41 includes N×M pixels 45, N first scan lines S1[1] through S1[N] formed in a row direction, N second scan lines S2[1] through S2[N], N emission scan lines E[1] through E[N], M data lines D[1] through D[M] formed in a column direction, and M power supply lines V[1] through V[M]. The first scan lines S1[1] through S1[N], the second scan lines S2[1] through S2[N], and the emission scan lines E[1] through E[N] transfer a first selection signal, a second selection signal, and an emission signal, respectively, to the pixels 45. Also, the data lines D1[1] through D[M] and the power supply lines V[1] through V[M] transfer a data signal and a supply voltage, respectively, to the pixels 45.

The data driver 44 applies the data signal to the data lines D1 through D[M]. The data signal can be outputted from a voltage source or a current source in the data driver 44.

The scan driver 42 applies the first selection signal and the second selection signal to the first scan lines S1[1] through S1[N] and the second scan lines S2[1] through S2[N], respectively. The first and second selection signals are sequentially applied to the first scan lines S1[1] through S1[N] and the second scan lines S2[1] through S2[N], respectively. The data signal is applied to a pixel circuit in synchronization with the first and second selection signals.

The emission driver 43 applies the emission signal to the emission scan lines E[1] through E[N]. A driving current is applied to an organic light emitting device, according to a voltage stored in a storage device (a capacitor) of the pixel circuit by the emission signal, so that the organic light emitting device emits light.

The double speed timing generator 46 doubles a frame frequency and applies the resultant frame signal to the scan driver 42 and/or the emission driver 43.

In general, the organic light emitting display apparatus is driven at a frame frequency of 60 Hz. In this case, the double speed timing generator 46 doubles the frame frequency of 60 Hz to 120 Hz, and applies the resultant frame signal to the scan driver 42 and/or emission driver 43.

The data signal converter 47 doubles an input data signal, divides a frame to two frames, applies a first data signal having a level higher than that of the input data signal to one frame, and applies a second data signal having a level lower than that of the input data signal to the other frame.

Preferably, a level difference between the first data signal and the input data signal is equal to a level difference between the second data signal and the input data signal.

Also, the data signal converter 47 doubles the input data signal, divides a frame to two frames, and applies a signal with a triangular wave over the two frames.

The signal with the triangular wave may be a signal which gradually rises from a first level lower than the level of the input data signal to the level of the input data signal in the first frame of the two frames, and then gradually falls from the level of the input data signal to a second level lower than the level of the input data signal in the second frame of the two frames. The first level may be equal to the second level.

The data signal converter 47 can be a micom or a Field Programmable Gate Array (FPGA).

The data synchronization emission control signal generator 48 generates an emission control signal synchronized with the input data signal, and applies the emission control signal to the emission driver 43.

The scan driver 42, the emission driver 43, and/or the data driver 44 can be electrically connected to an image display unit 41 such as a display panel, through wire bonding, etc, and can also be mounted as chips on a tape carrier package (TCP), etc, which is electrically connected to the image display unit 41. Also, the scan driver 42, the emission driver 43, and/or the data driver 44 can be mounted as chips on a flexible printed circuit (FPC) or a film, etc, which is attached and electrically connected to the image display unit 41. The structure is generally called a chip on film (COF) structure. Also, the scan driver 42, the emission driver 43, and/or the data driver 44 can be directly mounted on a glass substrate of the image display unit 41, or can be installed in a driving circuit which includes scan lines, data lines, and TFTs formed on the glass substrate.

Figure 5:
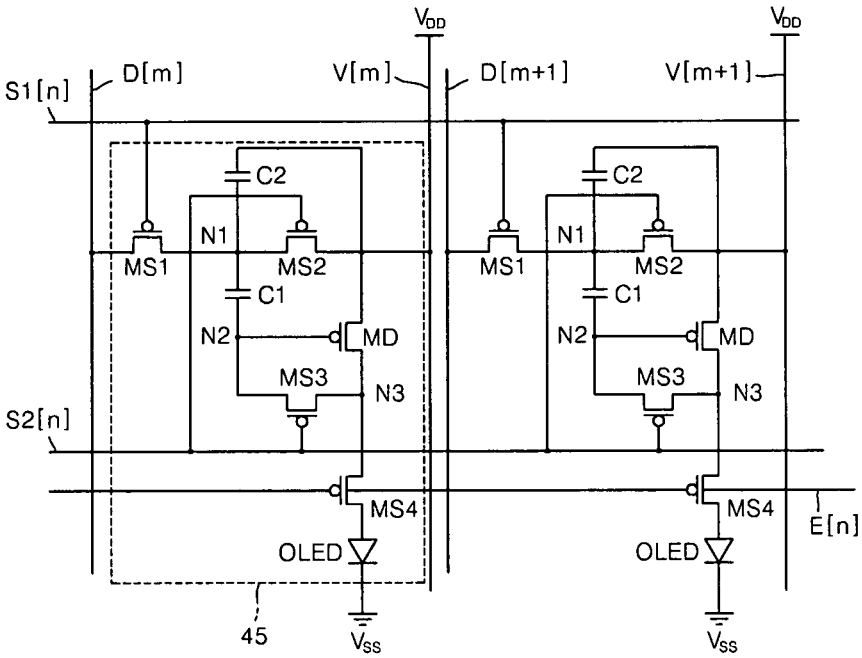
FIG. 5 is a circuit diagram of a pixel which is used in the organic light emitting display apparatus illustrated in FIG. 4, according to an embodiment of the present invention.

FIG. 5 is a circuit diagram of a pixel 45 which is used in the organic light emitting display apparatus illustrated in FIG. 4, according to an embodiment of the present invention.

Referring to FIG. 5, the pixel 45 includes an organic light emitting device (OLED) and a pixel circuit. The pixel circuit includes a driving transistor MD, first through fourth transistors MS1 through MS4, and first and second capacitors C1 and C2. Each of the driving transistor MD and the first through fourth transistors MS1 through MS4 includes a gate, a source, and a drain. Each of the first and second capacitors C1 and C2 includes a first terminal and a second terminal.

The gate of the first switching transistor MS1 is connected to the first scan line S1[n], the source of the first switching transistor MS1 is connected to the data line D[m], and the drain of the first switching transistor MS1 is connected to the first node N1. The first switching transistor MS1 applies a data voltage applied to the data line D[m] to the first node N1, in response to a first selection signal applied to the first scan line S1[n].

The gate of the second switching transistor MS2 is connected to the second scan line S2[n], the source of the second switching transistor MS2 is connected to the power supply line V[m], and the drain of the second switching transistor MS2 is connected to the first node N1. The second switching transistor MS2 applies a supply voltage, applied to the power supply line V[m], to the first node N1, in response to a second selection signal applied to the second scan line S2[n].

The gate of the third switching transistor MS3 is connected to the second scan line S2[n], the source of the third switching transistor MS3 is connected to the third node N3, and the drain of the third switching transistor MS3 is connected to a second node N2. The third switching transistor MS3 connects the gate and drain of the driving transistor MD, in response to a second selection signal applied to the second scan line S2[n], thereby diode-connecting the driving transistor MD.

The gate of the fourth switching transistor MS4 is connected to the emission scan line E[n], the source of the fourth switching transistor MS4 is connected to a third node N3, and the drain of the fourth switching transistor MS4 is connected to the organic light emitting device (OLED). The fourth switching transistor MS4 applies a current flowing through the driving transistor MD to the organic light emitting device (OLED), in response to an emission signal applied to the emission scan line E[n].

The first terminal of the first capacitor C1 is connected to the first node N1 and the second terminal of the second capacitor C1 is connected to the second node N2. The first capacitor C1 is charged according to a threshold voltage of the driving transistor MD while the second and third switching transistors MS2 and MS3 are turned on, and maintains the threshold voltage while the second and third transistors MS2 and MS3 are turned off.

The first terminal of the second capacitor C2 is connected to the power supply line V[m] and the second terminal of the second capacitor C2 is connected to the second node N2. The second capacitor C2 is charged according to a voltage obtained by subtracting the data voltage from the supply voltage, while the first switching transistor MS1 is turned on. The second capacitor C2 maintains the voltage while the first switching transistor MS1 is turned off.

The gate of the driving transistor MD is connected to the second node N2, the source of the driving transistor MD is connected to the power supply line V[m], and the drain of the driving transistor MD is connected to the third node N3. The driving transistor MD applies to the organic light emitting device (OLED) a current corresponding to a voltage between the first terminal of the second capacitor C2 and the second terminal of the first capacitor C1, while the fourth switching transistor MS4 is turned on.

Figure 6:
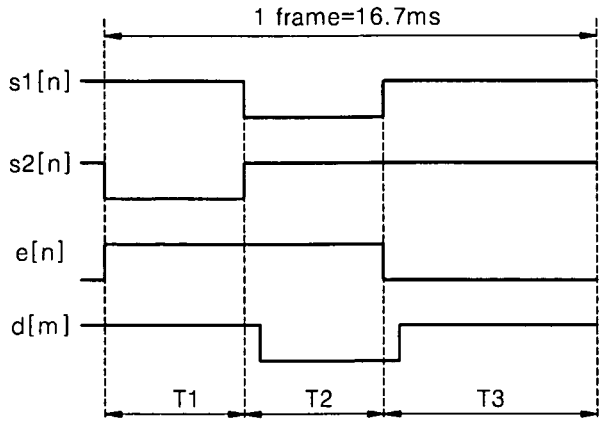
FIG. 6 is timing diagrams of conventional driving signals that are output to emission scan lines and selection scan lines driving a pixel circuit illustrated in FIG. 5.

FIG. 6 illustrates timing diagrams of conventional driving signals that are output to emission scan lines and selection scan lines for driving the pixel circuit illustrated in FIG. 5.

Hereinafter, the operation of the pixel circuit is described with reference to FIGS. 5 and 6. Referring to FIGS. 5 and 6, a first frame includes a first period T1, a second period T2, and a third period T3.

In the first period T1, the second selection signal s2[n] is "low", and the first selection signal s1[n] and the emission signal e[n] are "high". Accordingly, the second and third switching transistors MS2 and MS3 are turned on, and the first and fourth switching transistors MS1 and MS4 are turned off. In the first period T1, since a current flowing through the driving transistor MD becomes 0 A, a voltage $V_{GS}$ between the gate and source of the driving transistor MD becomes a threshold voltage, that is, $-|V_{TH}|$, and a voltage of the second terminal of the first capacitor C1 becomes $V_{DD}-|V_{TH}|$. Since the second switching transistor MS2 is turned on, a voltage of the first terminal of the first capacitor C1 becomes $V_{DD}$. Accordingly, a voltage between the first terminal and the second terminal of the first capacitor C1 becomes $|V_{TH}|$.

In the second period T2, the first selection signal s1[n] is "low", and the second selection signal s2[n] and the emission signal e[n] are "high". Accordingly, the first switching transistor MS1 is turned on, and the second, third and fourth switching transistors MS2, MS3, and MS4 are turned off. In the second period T2, since a data voltage $V_{DATA}$ is applied to the first terminal of the first capacitor C1, a voltage of the second terminal of the first capacitor C1, which is in a floating state, becomes $V_{DD}-|V_{TH}|$. Accordingly, a voltage $V_{DD}-V_{DATA}$ is charged between the first terminal and the second terminal of the second capacitor C2.

In the third period T3 which is a light emitting period, the emission signal e[n] is "low", and the first and second selection signals s1[n] and s2[n] are "high". Accordingly, the fourth switching transistor MS4 is turned on, and the first, second and third switching transistors MS1, MS2 and MS3 are turned off. In the third period T3, since a voltage between the gate and source of the driving transistor MD is maintained by the first and second capacitors C1 and C2, as seen in the following equation 1, a current $I_{OLED}$ flowing through the organic light emitting device OLED can be expressed by the following equation 2.

$$V_{GS}=V_{DATA}-|V_{TH}|-V_{DD} \quad (1)$$

$$I_{OLED}=(\beta/2)(V_{GS}-V_{TH})^2=(\beta/2)(V_{DD}-V_{DATA})^2 \quad (2)$$

As expressed by the equation 2, the current flowing through the organic light emitting device (OLED) of the pixel illustrated in FIG. 6 corresponds to the voltage $V_{DD}-V_{DATA}$ regardless of the threshold voltages of the driving transistors MD. That is, since deviation of the threshold voltages of the driving transistors MD is compensated by the pixel circuit, the organic light emitting display apparatus can achieve uniform display.

The driving signals illustrated in FIG. 6 have a frequency of 60 Hz, and accordingly, one frame is about 16.7 ms.

Figure 7:
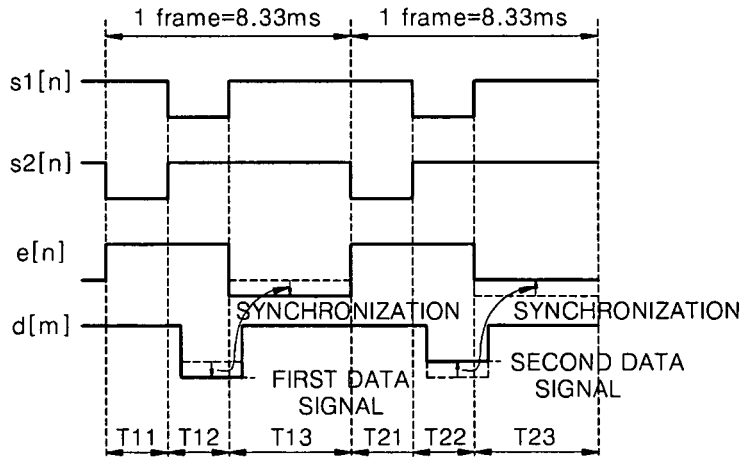
FIG. 7 is timing diagrams of driving signals that are output to emission scan lines and selection scan lines driving a pixel circuit illustrated in FIG. 5, according to an embodiment of the present invention.

FIG. 7 illustrates timing diagrams of driving signals that are output to emission scan lines and selection scan lines for driving the pixel circuit illustrated in FIG. 5, according to an embodiment of the present invention.

The driving signals illustrated in FIG. 7 have a frequency of 120 Hz, and accordingly, one frame is about 8.33 ms. The driving method according to an aspect of the present invention doubles a frame frequency of signals as illustrated in FIG. 6 applied to pixels of the organic light emitting display apparatus, as illustrated in FIG. 7, thereby dividing one frame into two frames. Here, it is possible to divide one frame into two frames and apply a signal applied to the original frame during each of the two frames.

Doubling of signals s1[n], s2[n], and e[n] applied to the first scan lines S1[1] through S1[N], the second scan lines S2[1] through S2[N], and the emission scan lines E[1] through E[N] can be performed by the double speed timing generator 46. Doubling of the signal d[m] applied to the data lines D[1] through D[M] can be performed by the data signal converter 47.

Referring to FIG. 7, a first data signal having a level lower than that of an original signal is applied to one frame of the two frames, and a second data signal having a level higher than that of the original signal is applied to the other frame of the two frames. In order to maintain brightness as it is, it is preferable that a level difference between the first data signal and the original signal be equal to a level difference between the second data signal and the original signal. The process can be performed by the data signal converter 47.

The level of the signal e[n] applied to the emission scan lines E[1] through E[N] is synchronized with the level of the data signal d[m].

Figure 8A:
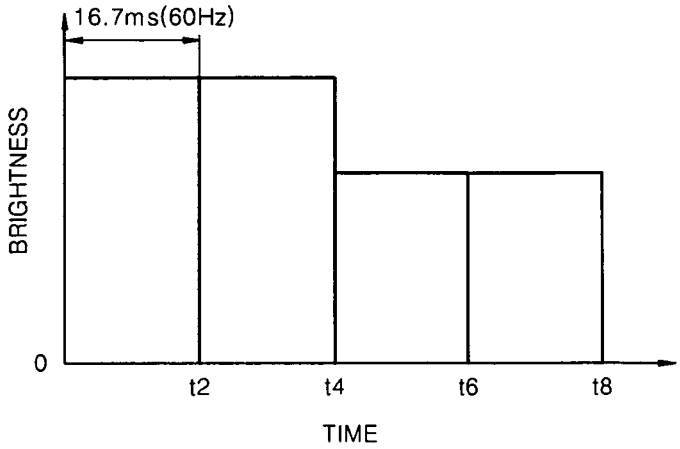
FIG. 8A is a timing diagram of a driving signal according to a conventional driving method, which is output to data lines of an organic light emitting display apparatus.

FIG. 8A is a timing diagram of a conventional driving signal that is output to data lines of an organic light emitting display apparatus.

Referring to FIG. 8A, the conventional driving signal has a frequency of 60 Hz, and one frame is about 16.7 ms. Light corresponding to an amount of brightness required for display is continuously displayed for each pixel during one frame.

In this case, as described above, motion blurring is generated and reproduction of moving pictures deteriorates.

Figure 8B:
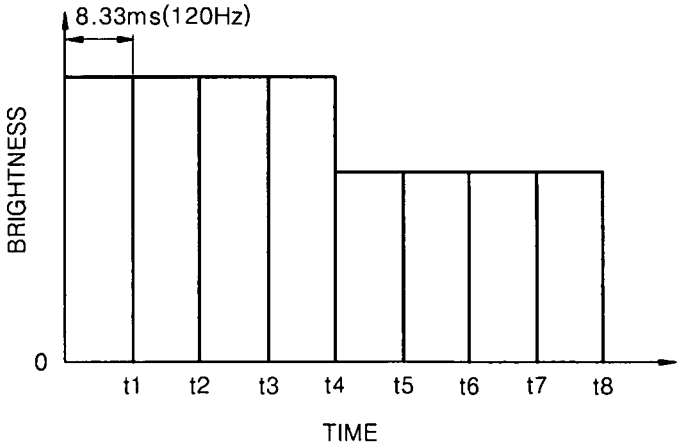
FIG. 8B is a timing diagram of a driving signal according to a conventional double speed driving method, which is output to data lines of an organic light emitting display apparatus.

FIG. 8B is a timing diagram of a driving signal according to a conventional double speed driving method, which is output to data lines of an organic light emitting display apparatus.

Referring to FIG. 8B, the driving signal has a frequency of 120 Hz and one frame is about 8.33 ms. That is, a frame frequency of signals applied to pixels of the organic light emitting display apparatus is doubled so that one frame as illustrated in FIG. 8A is divided into two frames. However, in this case, when moving pictures are displayed, motion blurring is generated.

Figure 8C:
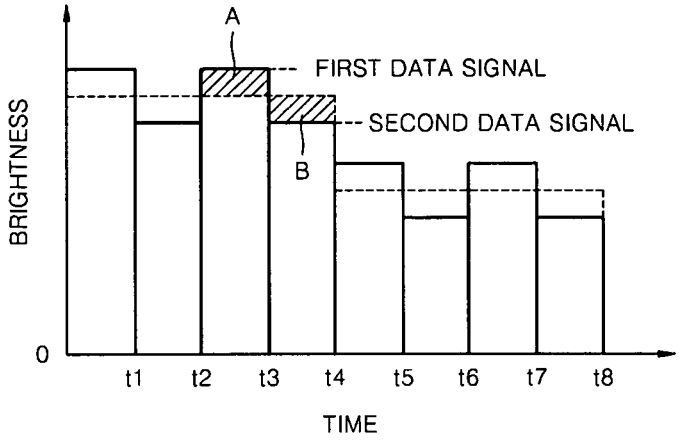
FIG. 8C is a timing diagram of a driving signal that is output to data lines of an organic light emitting display apparatus, according to an embodiment of the present invention.

FIG. 8C is a timing diagram of a driving signal that is output to data lines of an organic light emitting display apparatus, according to an embodiment of the present invention.

Referring to FIG. 8C, a first data signal having a level higher than that of an original signal is applied to the first frame of two frames, and a second data signal having a level lower than that of the original signal is applied to the second frame of the two frames.

Alternatively, it is also possible that a first data signal having a level higher than that of an original signal is applied to the second frame of two frames, and a second data signal having a level lower than that of the original is applied to the first frame of the two frames.

If square waveforms with different levels are applied as described above, it is possible to obtain effects similar to those obtained by an impulse waveform applied to an impulse type display apparatus and accordingly reduce motion blurring.

Referring to FIG. 8C, motion blurring and brightness deterioration are prevented. Accordingly, significant improvements can be obtained compared to the conventional technique in which brightness deterioration occurs in order to remove motion blurring and consumption power increases in order to reduce brightness deterioration.

When a level difference between the first data signal and the original signal is equal to a level difference between the second data signal and the original signal, that is, when an area A is equal to an area B, a uniform brightness can be obtained compared to the cases of FIGS. 8A and 8B.

Figure 8D:
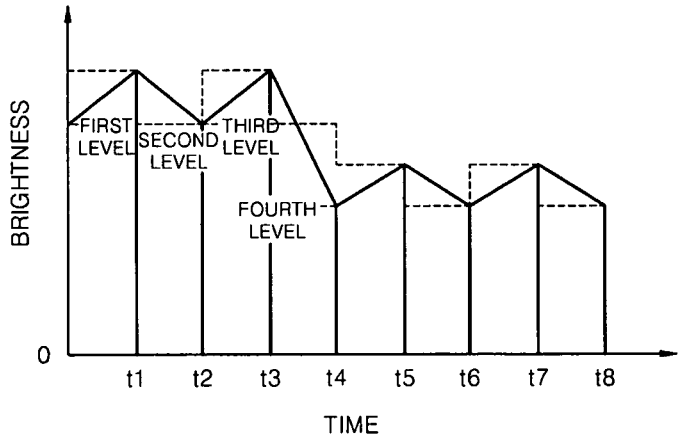
FIG. 8D is a timing diagram of a driving signal that is output to data lines of an organic light emitting display apparatus, according to another embodiment of the present invention.

FIG. 8D is a timing diagram of a driving signal that is output to data lines of an organic light emitting display apparatus, according to another embodiment of the present invention.

Referring to FIG. 8D, a data signal with a triangular wave is applied over two frames as described above with reference to FIG. 8B. If a triangular wave is applied as described above, it is possible to obtain effects more similar to those obtained by an impulse waveform applied to an impulse type display apparatus and accordingly further reduce motion blurring.

In FIG. 8D, motion blurring and brightness deterioration are prevented. Accordingly, significant improvements can be obtained compared to the conventional technique in which brightness deterioration occurs in order to remove motion blurring and consumption power increases in order to reduce brightness deterioration.

Referring to FIG. 8D, in the first frame 0-t1 of two frames, a signal gradually rising from a first level lower than a level of an original signal to the level of the original signal is applied, and in the second frame t1-t2 of the two frames, a signal gradually falling from the level of the original signal to a second level lower than the level of the original signal is applied. Here, the first level is equal to the second level.

Meanwhile, in the first frame t2-t3 of the following two frames, a signal gradually rising from a third level lower than the level of the original signal to the level of the original signal level is applied, and in the second frame t3-t4 of the two frames, a signal gradually falling from the level of the original signal to a fourth level lower than the level of the original signal is applied. Here, the third level can be different from the fourth level.

An aspect of the present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc.

In an organic light emitting display apparatus and a driving method thereof, according to an aspect of the present invention, it is possible to remove motion blurring generated when the organic light emitting display apparatus is driven and prevent deterioration in brightness and an increase in power consumption.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic light emitting display apparatus comprising:

a plurality of pixels, each pixel including an organic light emitting device (OLED) and a pixel circuit, the pixel circuit comprising a switch coupled to the OLED to control an emission period of the OLED;

a data driver for inputting a data signal to a plurality of data lines connected to the pixels;

a scan driver for applying a selection signal to a plurality of selection scan lines connected to the pixels;

a double speed timing generator for doubling a frame frequency and for applying a double speed frame signal to the scan driver;

a data signal converter for doubling the input data signal, for dividing one frame into two sub-frames, for applying a first data signal having a level higher than a level of the input data signal during one sub-frame of the two sub-frames, and for applying a second data signal having a level lower than the level of the input data signal during the other sub-frame of the two sub-frames; and an emission driver for applying an emission signal, which is applied to control the switch, to a plurality of emission scan lines, connected to the pixels, wherein the selection scan lines comprise a first selection scan line and a second selection scan line, wherein the pixel circuit comprises a first switching transistor, a second switching transistor, a first capacitor, a second capacitor, and a driving transistor, wherein the first switching transistor is configured to transfer a data voltage applied to the plurality of data lines in response to a first selection signal applied to the first selection scan line, wherein the first capacitor is configured to store a voltage corresponding to a threshold voltage of the driving transistor, wherein the second capacitor is configured to store a voltage corresponding to the transferred data voltage, wherein the second switching transistor is configured to electrically connect a terminal of the first capacitor to a power supply line in response to a second selection signal applied to the second selection scan line, and wherein the driving transistor is configured to supply a current from the power supply line to the organic light emitting device corresponding to the voltages stored in the first capacitor and the second capacitor.

2. The organic light emitting display apparatus of claim 1, wherein the double speed timing generator doubles the frame frequency to generate the double speed frame signal, and applies the double speed frame signal to the emission driver.

3. The organic light emitting display apparatus of claim 1, further comprising a data synchronization emission control signal generator generating an emission control signal synchronized with the input data signal and applying the emission control signal to the emission driver.

4. The organic light emitting display apparatus of claim 1, wherein a level difference between the first data signal and the input data signal is equal to a level difference between the second data signal and the input data signal.

5. An organic light emitting display apparatus comprising:

a plurality of pixels, each pixel including an organic light emitting device (OLED) and a pixel circuit;

a data driver for inputting a data signal to a plurality of data lines connected to the pixels;

a scan driver for applying a selection signal to a plurality of selection scan lines connected to the pixels;

a double speed timing generator for doubling a frame frequency and for applying a double speed frame signal to the scan driver; and a data signal converter for doubling the input data signal, for dividing one frame into two sub-frames, for applying a first data signal having a level higher than a level of the input data signal during one sub-frame of the two sub-frames, and for applying a second data signal having a level lower than the level of the input data signal during the other sub-frame of the two sub-frames, wherein the selection scan lines comprise a first selection scan line and a second selection scan line, wherein the pixel circuit comprises a first switching transistor, a second switching transistor, a first capacitor, a second capacitor, and a driving transistor, wherein the first switching transistor transfers a data voltage applied to the plurality of data lines in response to a first selection signal applied to the first selection scan line, wherein the first capacitor stores a voltage corresponding to a threshold voltage of the driving transistor, wherein the second capacitor stores a voltage corresponding to the transferred data voltage, wherein the second switching transistor connects a terminal of the first capacitor to a power supply line, in response to a second selection signal applied to the second selection scan line, and wherein the driving transistor supplies a current from the power supply line to the organic light emitting device, in correspondence to the voltages stored in the first capacitor and the second capacitor.

6. The organic light emitting display apparatus of claim 5, wherein the pixel circuit further comprises a third switching transistor diode-connecting the driving transistor in response to the second selection signal.

7. The organic light emitting display apparatus of claim 5 wherein the pixel circuit further comprises a fourth switching transistor disconnecting the organic light emitting device from the driving transistor, in response to an emission signal applied to emission scan lines.

8. An organic light emitting display apparatus comprising:

a plurality of pixels, each pixel comprising an organic light emitting device and a pixel circuit;

a data driver for inputting a data signal to a plurality of data lines connected to the pixels;

a scan driver for applying a selection signal to a plurality of selection scan lines connected to the pixels;

a double speed timing generator for doubling a frame frequency and for applying a double speed frame signal to the scan driver; and a data signal converter for doubling the input data signal, for dividing a frame into two sub-frames, and for applying the input signal in a form of a triangular wave during the two sub-frames, wherein the data signal converter is configured to apply a first signal gradually rising from a first level lower than a level of the input data signal to the level of the input data signal during a first sub-frame of the two sub-frames, and is configured to apply a second signal gradually falling from the level of the input data signal to a second level lower than the level of the input data signal during a second sub-frame of the two sub-frames.

9. The organic light emitting display apparatus of claim 8, wherein the first level is equal to the second level.

10. The organic light emitting display apparatus of claim 8, further comprising an emission driver applying an emission signal to a plurality of emission scan lines connected to the pixels.

11. The organic light emitting display apparatus of claim 10, wherein the double speed timing generator doubles the frame frequency to generate the double speed frame signal, and applies the double speed frame signal to the emission driver.

12. The organic light emitting display apparatus of claim 10, further comprising a data synchronization emission control signal generator generating an emission control signal synchronized with the input data signal and applying the emission control signal to the emission driver.

13. A driving method of an organic light emitting display apparatus comprising a scan driver for applying a selection signal to a plurality of selection scan lines connected to pixels including pixel circuits, and an emission driver for applying an emission signal that is configured to control a switch to a plurality of emission scan lines, the method comprising:

doubling a frame frequency of signals applied to pixels of an organic light emitting display and dividing one frame into two sub-frames; and applying a first data signal having a level higher than a level of an input data signal during one sub-frame of the two sub-frames and applying a second data signal having a level lower than the level of the input data signal during the other sub-frame of the two sub-frames, wherein the selection scan lines comprise a first selection scan line and a second selection scan line, wherein the pixel circuit comprises a first switching transistor, a second switching transistor, a first capacitor, a second capacitor, and a driving transistor, wherein the first switching transistor is configured to transfer a data voltage applied to a plurality of data lines in response to a first selection signal applied to the first selection scan line, wherein the first capacitor is configured to store a voltage corresponding to a threshold voltage of the driving transistor, wherein the second capacitor is configured to store a voltage corresponding to the transferred data voltage, wherein the second switching transistor is configured to electrically connect a terminal of the first capacitor to a power supply line in response to a second selection signal applied to the second selection scan line, and wherein the driving transistor is configured to supply a current from the power supply line to the organic light emitting device corresponding to the voltages stored in the first capacitor and the second capacitor.

14. The driving method of claim 13, wherein a level difference between the first data signal and the input data signal is equal to a level difference between the second data signal and the input data signal.

15. A driving method of an organic light emitting display apparatus comprising a scan driver for applying a selection signal to a plurality of selection scan lines connected to pixels including pixel circuits, and an emission driver for applying an emission signal that is configured to control a switch to a plurality of emission scan lines, the method comprising:

doubling a frame frequency of signals applied to pixels of the organic light emitting display apparatus and dividing one frame into two sub-frames; and applying a data signal during the two sub-frames, wherein the data signal gradually rising from a first level lower than a level of an input data signal to the level of the input data signal is applied during a first sub-frame of the two sub-frames, and the data signal gradually falling from the level of the input data signal level to a second level lower than the level of the input data signal is applied during a second sub-frame of the two sub-frames, wherein the data signal is triangular, wherein the selection scan lines comprise a first selection scan line and a second selection scan line, wherein the pixel circuit comprises a first switching transistor, a second switching transistor, a first capacitor, a second capacitor, and a driving transistor, wherein the first switching transistor is configured to transfer a data voltage applied to a plurality of data lines in response to a first selection signal applied to the first selection scan line, wherein the first capacitor is configured to store a voltage corresponding to a threshold voltage of the driving transistor, wherein the second capacitor is configured to store a voltage corresponding to the transferred data voltage, wherein the second switching transistor is configured to electrically connect a terminal of the first capacitor to a power supply line in response to a second selection signal applied to the second selection scan line, and wherein the driving transistor is configured to supply a current from the power supply line to the organic light emitting device corresponding to the voltages stored in the first capacitor and the second capacitor.

16. The driving method of claim 15, wherein the first level is equal to the second level.

* * * * *